US009067206B2

(12) United States Patent
Park

(10) Patent No.: US 9,067,206 B2
(45) Date of Patent: Jun. 30, 2015

(54) CHIP FOR ANALYZING FLUIDS BEING MOVED WITHOUT AN OUTSIDE POWER SOURCE

(75) Inventor: Ji-Young Park, Seoul (KR)

(73) Assignee: NANOENTEK, INC., Seoul (KR)

( * ) Notice: Subject to any disclaimer, the term of this patent is extended or adjusted under 35 U.S.C. 154(b) by 87 days.

(21) Appl. No.: 13/079,299

(22) Filed: Apr. 4, 2011

(65) Prior Publication Data

US 2011/0243795 A1 Oct. 6, 2011

(30) Foreign Application Priority Data

Apr. 5, 2010 (KR) ..... 10-2010-0030995

(51) Int. Cl.
*B01L 3/00* (2006.01)
*G01N 1/10* (2006.01)

(52) U.S. Cl.
CPC ... *B01L 3/502746* (2013.01); *B01L 2200/0636* (2013.01); *B01L 2200/0684* (2013.01); *B01L 2300/0809* (2013.01); *B01L 2300/089* (2013.01); *B01L 2400/0406* (2013.01); *B01L 2400/086* (2013.01)

(58) Field of Classification Search
CPC ..... B01L 2400/0406; B01L 2200/0605; B01L 2200/0636; B01L 2200/0684; B01L 2300/046; B01L 2300/047; B01L 2300/0809; B01L 2300/0838; B01L 2300/089; B01L 2400/0683; B01L 2400/086; B01L 3/502; B01L 3/502746; B01L 3/563; G01N 1/38
USPC ..... 422/500–505; 436/180
See application file for complete search history.

(56) References Cited

U.S. PATENT DOCUMENTS 5,922,604 A 7/1999 Stapleton et al.
6,156,270 A * 12/2000 Buechler ..... 422/417
6,271,040 B1 8/2001 Buechler
(Continued)

FOREIGN PATENT DOCUMENTS

CN 1597119 3/2005
CN 101258405 9/2008
(Continued)

OTHER PUBLICATIONS

Notice of Allowance—Korean Patent Application No. 10-2010-0030995 dated May 27, 2010.
(Continued)

*Primary Examiner* — Dean Kwak
(74) *Attorney, Agent, or Firm* — Sherr & Jiang, PLLC

(57) ABSTRACT

A chip for analyzing fluid being moved without an outside power source includes: a pre-treatment portion into which fluid of a target-being analyzed substance is injected and mixed with an identification substance; a channel portion in which a specific reaction of the fluid such as an antigen-antibody reaction is conducted; and a washing portion into which the fluid is received. The pre-treatment portion includes: a specimen injection portion into which the fluid is injected; a first buffer portion protruding upwardly with respect to the specimen injection portion connected thereto to have a height greater than that of the specimen injection portion relative to the channel portion, such that the fluid is firstly received in the first buffer portion; and at least one specimen leading guide which destroys surface tension of the fluid flow moving from the specimen injection portion to the first buffer portion.

27 Claims, 7 Drawing Sheets

(56) References Cited

U.S. PATENT DOCUMENTS

| | | | | |
|---|---|---|---|---|
| 2004/0265171 | A1 | 12/2004 | Pugia et al. | |
| 2005/0026346 | A1 | 2/2005 | Blankenstein et al. | |
| 2007/0161051 | A1* | 7/2007 | Tsinberg et al. | 435/7.2 |
| 2007/0269893 | A1 | 11/2007 | Blankenstein et al. | |
| 2008/0000833 | A1 | 1/2008 | Peters et al. | |
| 2008/0003572 | A1 | 1/2008 | Delamarche et al. | |
| 2008/0176272 | A1 | 7/2008 | Bergman et al. | |
| 2008/0257754 | A1 | 10/2008 | Pugia et al. | |
| 2010/0009430 | A1 | 1/2010 | Wan et al. | |
| 2011/0030458 | A1 | 2/2011 | Park et al. | |

FOREIGN PATENT DOCUMENTS

| | | |
|---|---|---|
| DE | 102005061811 | 6/2007 |
| EP | 1385002 | 1/2004 |
| EP | 1566215 | 8/2005 |
| JP | 06-094722 | 4/1994 |
| JP | 3325018 | 9/2002 |
| KR | 10-2006-0017701 | 2/2006 |
| KR | 10-2009-0010509 | 1/2009 |
| KR | 10-2009-0010510 | 1/2009 |
| KR | 100878229 | 1/2009 |
| KR | 100900511 | 5/2009 |
| KR | 100905954 | 6/2009 |
| WO | 2008/137212 | 11/2008 |
| WO | 2009/014379 | 1/2009 |
| WO | 2009/066948 | 5/2009 |

OTHER PUBLICATIONS

European Search Report—EP 11 16 1144 dated Nov. 17, 2011.

* cited by examiner

CHIP FOR ANALYZING FLUIDS BEING MOVED WITHOUT AN OUTSIDE POWER SOURCE

FIELD OF THE INVENTION

The present invention relates to a chip for analyzing fluids being moved without an outside power source, and more particularly, to a chip for analyzing fluids being moved without an outside power source in which a moving pattern of the fluid passing through a channel portion is formed evenly and thus bubble creation is decreased and reproducibility thereof is ensured and further a signal detection from a target-being analyzed substance is performed easily.

BACKGROUND OF THE INVENTION

Generally, a biological, chemical or optical analyzing method of a fluid specimen has been used mainly in the fields of analyzing blood or body fluid taken from a patient in a clinic and diagnosing disease as well as in the chemical or biotechnology fields. In order to provide a small-sized analytical or diagnostic tool capable of analyzing efficiently a fluid specimen various chip structures have been developed and used. As one of these structures, a lab-on-a-chip has been introduced through which various functions are performed in one chip to analyze efficiently a specimen and diagnose disease and further a rapid diagnosis kit can be made.

The lab-on-a chip refers to implementing various experimental procedures performed in a laboratory, for example, separating, refining, mixing, labeling analyzing and washing, etc. of specimens, on a small chip. In a design of the lap-on-a chip, the technologies related to micro-fluidics and a micro-Liquid Handling System ("micro-LHS") have been mainly used. Additionally, for fabricating a chip structure for implementing micro-fluidics and micro-LHS a chip has been developed and launched on to the market, in which fine channels are formed using a semiconductor circuit design technology.

Typically, an analyzing procedure of a minimum amount of a target-being analyzed substance which is contained within fluid specimens such as blood or body fluid, etc. includes the steps of moving the fluid specimens through a tube-shaped channel formed within a chip and seeing at the course of movement whether the fluid specimens are reacted with proteins of antigens or antibodies, etc. or another protein, which is pre-fixed to the chip, through a detection of fluorescent material. Accordingly, an observing technology of fluid flow moving through the channel provided on a chip, including a fabricating technology of the channel structure, is considered to be one of best essential technologies in the field of manufacturing small sized-chips for performing fluid analysis and acquiring accurate results thereof using the chip.

Referring to a chip (or chip structure) provided with fine channels for implementing micro-fluidics, a small motor for compressing fluid or a capillary phenomenon induced by limiting width and height of the channel for moving the fluid has been used for the fluid to be moved into a space formed within a fine channel inside the chip. At the present, it has been studied that when a main driving force for inducing fluid movement in a chip is capillary force, the fluid flowing through the space formed by channel has an irregular and uneven movement pattern. This result is to be understood that the interaction force between upper-lower inner walls and the fluid, and the other interaction force between left-right inner walls and the fluid are not equal to each other. As a result, this uneven fluid movement pattern becomes a big obstacle to detecting and analyzing the target-being analyzed substance which exists in a minimum amount in a fluid specimen.

Meanwhile, when a chip is configured such that a specimen input hole and a specimen output hole are provided on both ends of a channel so that the fluid inputted to the specimen hole is discharged through a closed-channel such as a tube to the specimen output hole, two upper and lower substrates are fabricated separately and then are connected generally. However, in the case of manufacturing a fine channel structure having a size of less than ten microns according to the prior art, it is not easy to process evenly corners of the channel without loss and further it is difficult to manage product size and control quality when chips are mass-produced. In addition, these minute differences of channel configurations prevent the fluid from being flowed evenly, causing inconsistent specimen analysis results from the chip which is aimed at detecting a trace amount of target-being analyzed substance from a minimum amount of specimen.

Accordingly, need exists for studying and development of a chip for analyzing fluid in which a moving pattern of the fluid is formed evenly and thus bubble creation is decreased and reproducibility thereof is ensured and further a signal detection from a target-being analyzed substance which exists in the fluid is performed easily.

SUMMARY OF THE INVENTION

The present invention has been proposed to solve the aforementioned drawbacks of the prior art, and one object of the present invention relates to providing a chip for analyzing fluid being moved without an outside power source in which a moving pattern of the fluid passing through a channel portion is formed evenly and thus bubble creation is decreased and reproducibility thereof is ensured and further a signal detection from a target-being analyzed substance is performed easily.

The above object is achieved by a chip for analyzing fluid being moved without an outside power source comprising: a pre-treatment portion into which target-being analyzed substance is injected and received; a channel portion through which the fluid received in the pretreatment portion is moved and in which specific reaction of the fluid such as antigen-antibody reaction is conducted; and a washing portion into which the fluid passing through the channel portion is received wherein the pre-treatment portion includes: a specimen injection portion into which the fluid is injected; a first buffer portion having a step difference with respect to the specimen injection portion for the fluid to be firstly received; and at least one specimen leading guide which is provided between the specimen injection portion and the first buffer portion and destroys surface tension of the fluid flow moving from the specimen injection portion to the first buffer portion side and thus stabilizes flow surface of the fluid.

The specimen leading guide may be plural specimen leading guides which protrude from the center area of a slanted surface connecting the upper surface of the specimen injection portion and the upper surface of the first buffer portion, to be spaced from each other at a predetermined space.

The pre-treatment portion further may comprise a first guide provided along upper surface circumferences of the specimen injection portion and the first buffer portion.

At least one vent hole may be formed through the first buffer portion, which delays flow velocity of the fluid moving along the first guide and suppresses bubbles to be created in the fluid.

The vent hole may be a pair of vent holes each formed through left and right sides of the upper surface of the first buffer portion, respectively.

The first buffer portion may comprise a plurality of mixing pillars which protrude from the upper surface of the first upper surface toward a lower side thereof to increase surface area with which the fluid contacts.

The pre-treatment portion further may comprise: a second buffer portion into which the fluid is received secondly and is spaced at a predetermined distance from the first buffer portion and has smaller volume than that of the first buffer portion; and a first conjugate portion which is provided between the first buffer portion and the second buffer portion for the target-being analyzed substance within the fluid to be reacted with an identification substance.

The first guide may protrude toward a lower side along circumferences of the specimen injection portion and the first buffer portion and may be closed at the lower surfaces of the specimen injection portion and the first buffer portion.

The first guide may protrude toward a lower side within a range of 1-10 along circumferences of the upper surfaces of the specimen injection portion and the first buffer portion.

The first conjugate portion may comprise at least one first tunnel wall which protrudes from an upper surface of the first conjugate toward a lower side and concentrates fluid flow for the fluid to be flowed in one direction.

The first tunnel wall may be a pair of tunnel walls each protruding symmetrically on both sides of one end of the first conjugate portion.

The first conjugate portion may comprise at least one second tunnel wall which protrudes from the upper surface of the first conjugate toward a lower side and concentrates fluid flow for the fluid to be flowed in one direction.

The second tunnel wall may be a pair of tunnel walls each protruding symmetrically on both sides of the other end of the first conjugate portion.

The second buffer portion may comprise a plurality of buffer portion pillars which protrude from the upper surface of the second buffer portion toward a lower side and mixes the fluid with the identification substance.

The second buffer portion may comprise at least one second guide which protrudes from the upper surface of the second buffer portion toward a lower side and concentrates the fluid flow toward the center.

The second guide may be a pair of guides each protruding downward at left and right sides of the upper surface of the second buffer portion.

A water leak proof hole may be formed through at an adjacent location to both sides of the second buffer portion.

The specimen injection portion may comprise a plurality of injection portion pillars which protrude from the upper surface of the specimen injection portion toward a lower side.

The channel portion may comprise a chamfering portion at least a part of which is chamfered along a lower end lengthwise direction of at least one side wall among the side walls.

The chamfering portion may be a pair of chamfering portions provided continuously along a lengthwise direction of both side walls of the channel portion.

A flow velocity delay hole may be formed through on one end of the channel portion.

The washing portion may comprise a washing channel into which the fluid passing through the channel portion is received and a washing channel introduction portion connecting the channel portion with the washing channel.

The washing channel introduction portion may be provided having smaller volume than that of the washing channel.

The washing channel introduction portion may be formed with the distance from the lower surface to the upper surface being increased gradually as the washing channel introduction portion proceeds to the washing channel side.

The washing channel may comprise a washing volume increasing portion provided on one end of the washing channel, with a distance from the lower surface to the upper surface being increased gradually, The washing channel may comprise a plurality of washing pillar portions which protrude from the upper surface of the washing channel.

The plural pillar portions may be formed being gradually denser toward the tip end of the washing channel.

At least one washing portion vent hole may be formed through on one end of the washing channel.

The washing portion vent hole may be formed on the center area in a widthwise direction of the washing channel.

DETAILED DESCRIPTION OF THE PREFERRED EMBODIMENTS

The preferred embodiments of a chip for analyzing fluid according to the present invention will be described in detail referring to the accompanied drawings. However, it has to be understood that the present invention is not limited to the provided embodiments without departing from a spirit of the present invention.

Figure 1:
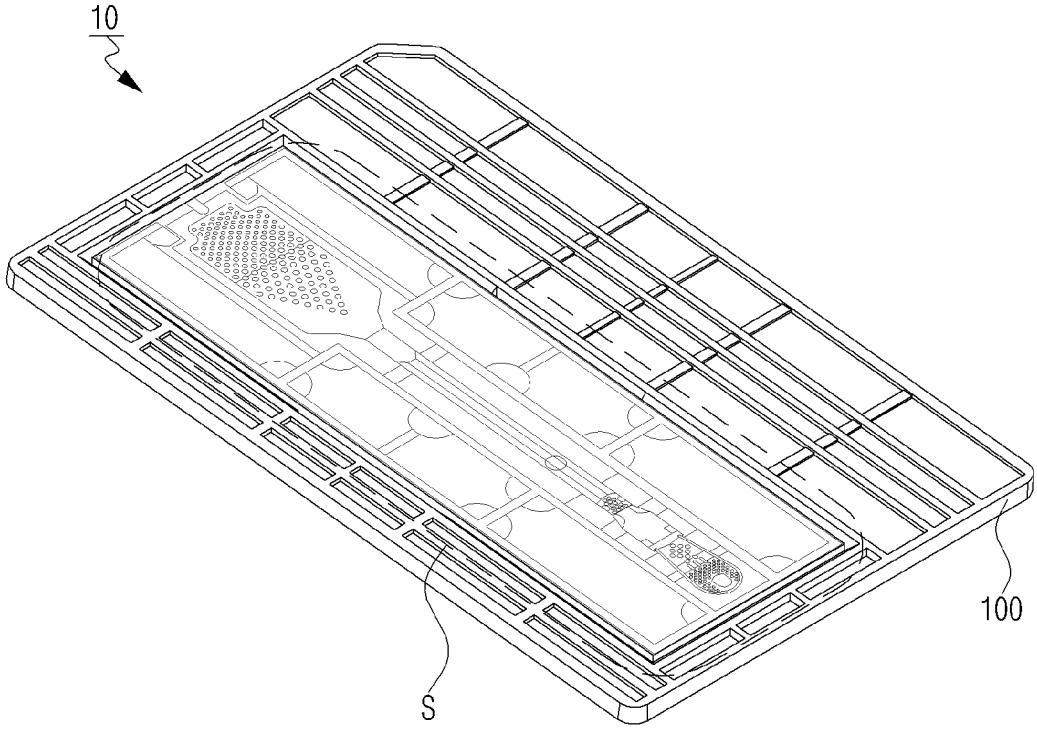
FIG. 1 is a perspective view of a chip for analyzing fluid according to one embodiment of the present invention.
Figure 2:
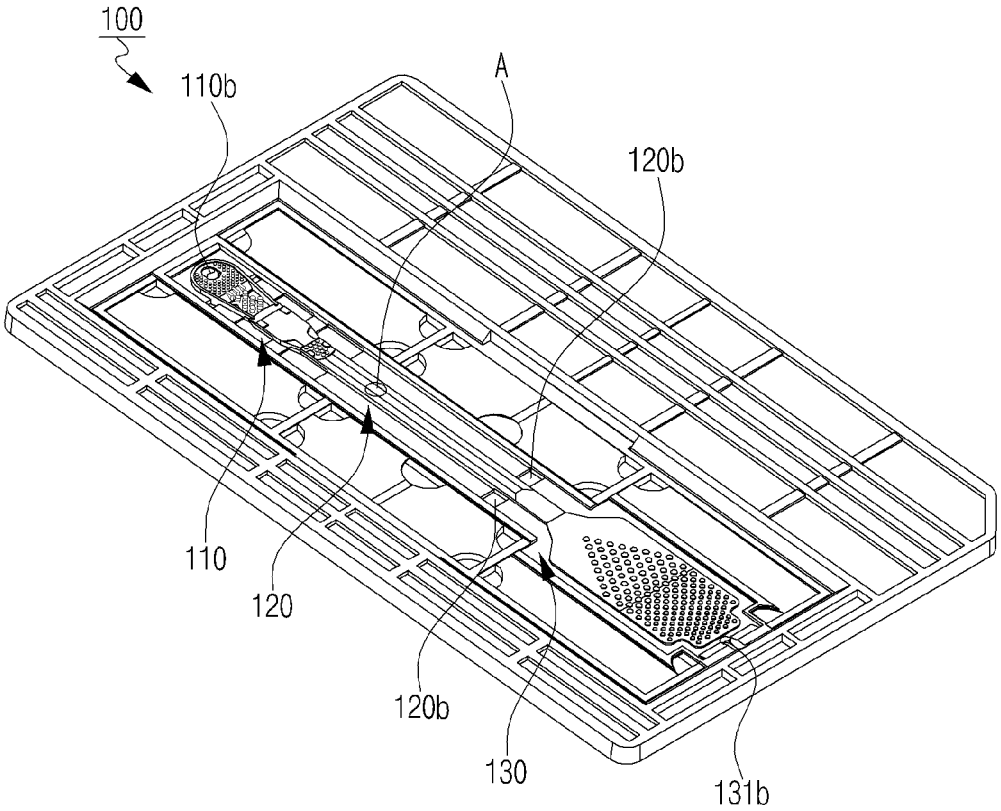
FIG. 2 is a perspective view of a lower part of a first plate provided on the chip for analyzing fluid as shown in FIG. 1.
Figure 3:
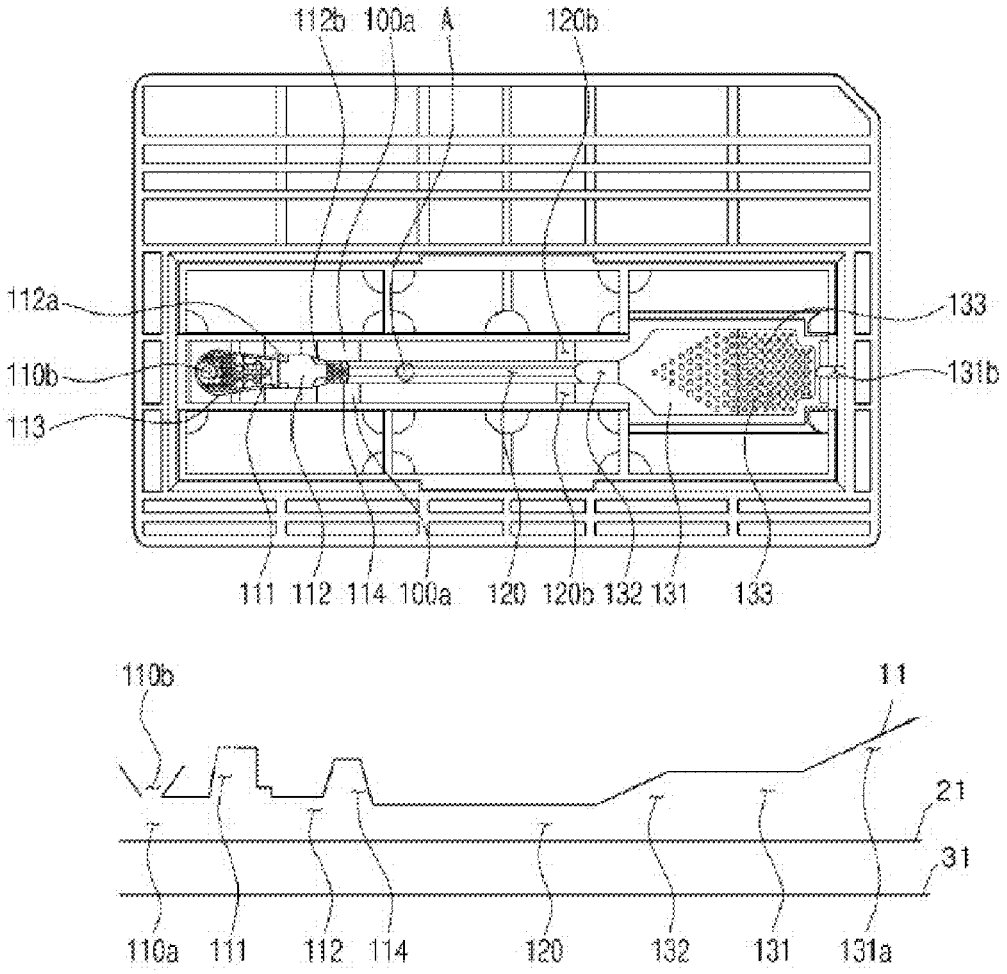
FIG. 3 is top view of a lower part of a first plate provided on the chip for analyzing fluid as shown in FIG. 1.
Figure 4:
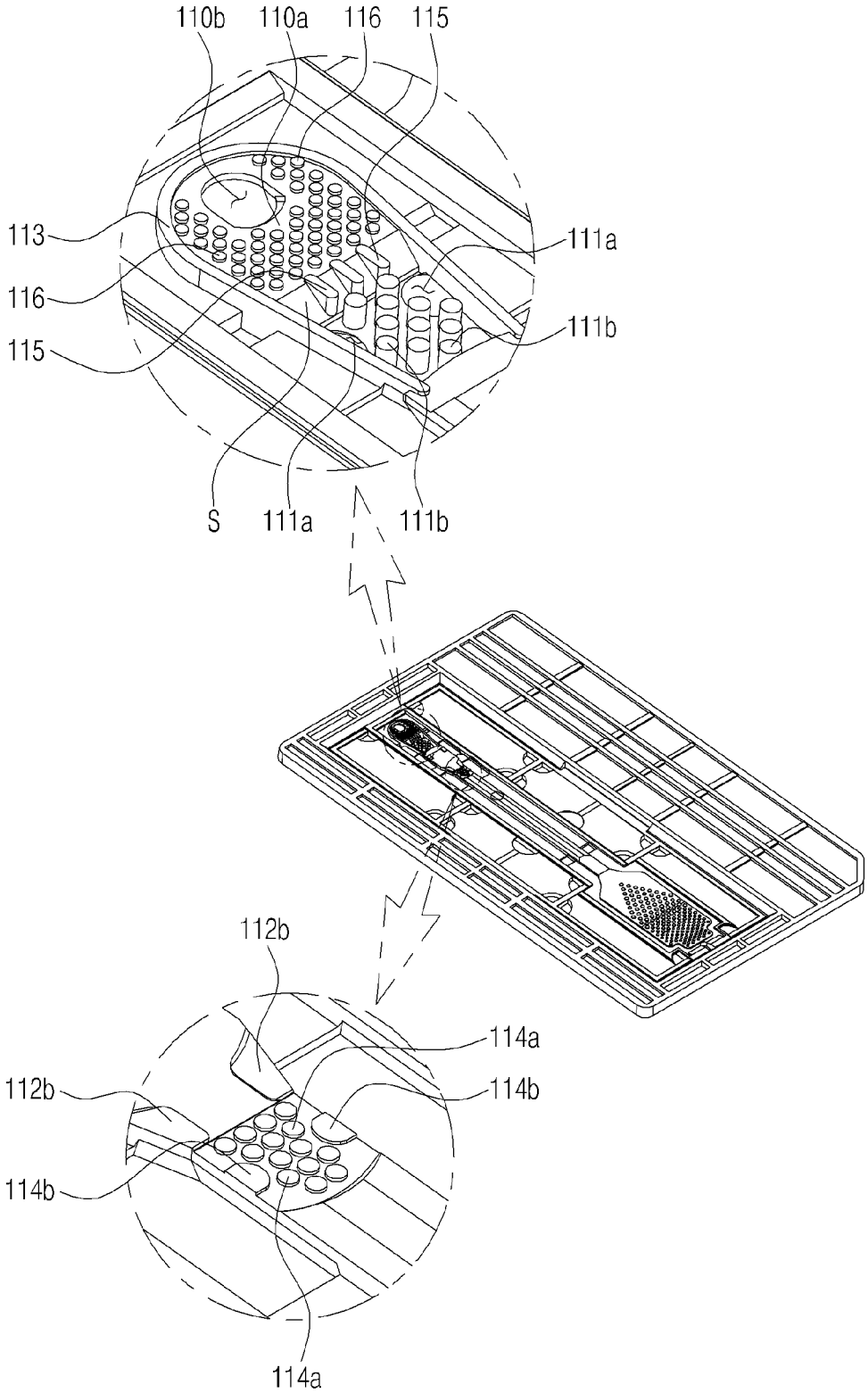
FIG. 4 is an enlarged-view of main parts of a first plate as shown in FIG. 2.
Figure 5:
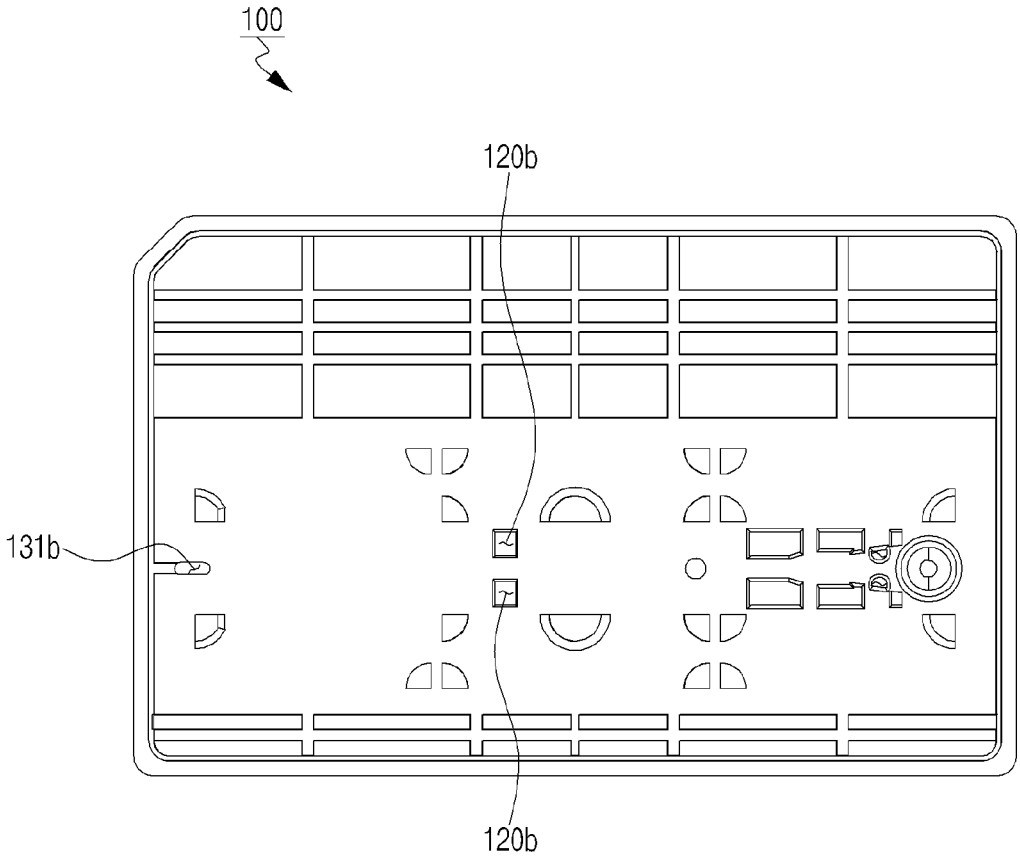
FIG. 5 is a top view of an upper part of a first plate provided on the chip for analyzing fluid as shown in FIG. 1.
Figure 6:
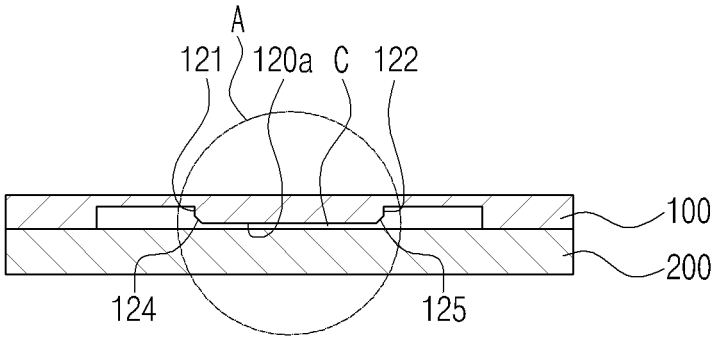
FIG. 6 is a sectional view of a channel portion provided on the chip for analyzing fluid as shown in FIG. 1.
Figure 7:
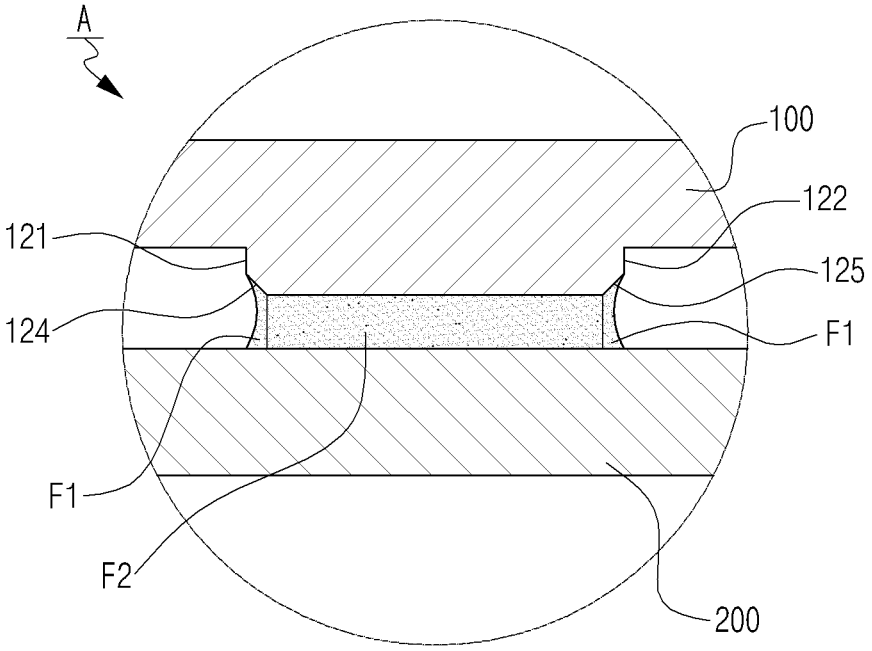
FIG. 7 is an enlarged-view of FIG. 6.

Referring again to accompanied drawings, FIG. 1 is a perspective view of a chip for analyzing fluid according to one embodiment of the present invention, FIG. 2 is a perspective view of a lower part of a first plate provided on the chip for analyzing fluid as shown in FIG. 1, FIG. 3 is top view of a lower part of a first plate provided on the chip for analyzing fluid as shown in FIG. 1, FIG. 4 is an enlarged-view of main parts of a first plate as shown in FIG. 2, FIG. 5 is a top view of an upper part of a first plate provided on the chip for analyzing fluid as shown in FIG. 1, FIG. 6 is a sectional view of a channel portion provided on the chip for analyzing fluid as shown in FIG. 1, and FIG. 7 is an enlarged-view of FIG. 6.

Hereinafter, though the chip for analyzing fluid is described in state of a first plate and a second plate being connected and completed, it is to be understood that a scope of the present invention is not limited thereto.

As shown in the accompanied drawings, a chip for analyzing fluid being moved without an outside power source 10 (hereinafter, referred to as "a chip for analyzing fluid 10"), includes a pre-treatment portion 110 in which a target-being analyzed substance is injected and received, a channel portion 120 through which the fluid received in the pre-treatment portion 110 is moved and in which a specific reaction such as antigen-antibody reaction is conducted produced, and a washing portion 130 in which remaining fluid passing through the channel portion 120 is received.

Meanwhile, the pre-treatment portion 110 is provided for the fluid injected through a specimen injection opening 110*b* to be moved smoothly to the channel portion 120 wherein the pre-treatment portion 110 includes a specimen injection portion 110*a* provided near the specimen injection opening 110*b*, a first buffer portion 111 having a step difference with respect to the specimen injection portion 110*a* for the fluid being received firstly, a first conjugate portion 112 through which a target-being analyzed substance within the fluid moving through the first buffer portion 111 is reacted with an identification substance, a first guide 113 provided for preventing the fluid from being leaked outside when the first plate 100 and a second plate 200 (FIGS. 5 and 6) are connected, and a second buffer portion 114 spaced at a predetermined distance from the first buffer portion 111 and having a smaller volume than that of the first buffer portion 111.

Here, the specimen injection portion 110*a*, the first buffer portion 111, the first conjugate portion 112 and the second buffer portion 114 each refer to a chamber which is to be formed by connection of the first plate 100 and the second plate 200, and hereinafter an upper surface 11 and lower surface 21 each refer to a lower side surface of the first plate 100 and an upper side surface of the second plate 200, respectively, defining a space of the chamber. In addition, a bottom surface 31 refers to a lower side surface of the second plate 200.

The specimen injection portion 110*a* is configured such that the fluid injected through the specimen injection opening 110*b* is stored temporally and then is moved toward the first buffer portion 111 wherein the specimen injection portion includes a plurality of injection portion pillars 116 formed in a state of protruding downward from the upper surface 11 thereof.

That is, the plural injection portion pillars 116 are formed at a location near the specimen injection opening 110*b* such that they are spaced from each other at a predetermined distance and protrude from the upper surface 11 of the specimen injection portion 110*a*. The injection portion pillars 116 serve to increase a surface area of the part adjacent to the specimen injection opening 110*b* side and thus increase a mixing effect of the fluid injected through the specimen injection opening 110*b* and a sample buffer applied on the lower surface 21 of the specimen injection opening 110*b*.

In addition, the fluid stored temporally in the specimen injection portion 110*a* is received firstly into the first buffer portion 111 and a predetermined amount of the fluid is stored therein, controlling the volume of fluid to be inputted into the channel part 120.

Here, the first buffer portion 111 having a step difference with respect to the specimen injection portion 110*a* and further a slanted surface S is provided between the specimen injection portion 110*a* and the first buffer portion 111 to connect therebetween (see FIG. 4).

Meanwhile, the fluid flow moving from the specimen injection portion 110*a* toward the first buffer portion 111 may be unstable due to the step difference formed between the specimen injection portion 110*a* and the first buffer portion 111. That is, the first buffer portion 111 has a height greater than that of the specimen injection portion 110*a*, which is connected continuously to the first buffer portion, and thus it may be difficult for the fluid to be inputted into the first buffer portion 111 due to the step difference between the specimen injection portion 110*a* and the first buffer portion 111.

Here, when the fluid inputting into the first buffer portion 111 is to be interrupted due to the step difference between the specimen injection portion 110*a* and the first buffer portion 111, a part surface of the fluid inputting to the first buffer portion 111 may be unstable and thus the fluid may flow partially to one side of the first buffer portion 111 or bubbles may be created. That is, as a surface velocity of the fluid inputting into the first buffer portion 111 through the specimen injection portion 110*a* is more speedy relatively than that of the following fluid lump, the fluid surface proceeds ahead of the fluid lump and as a result uneven flow of the fluid with an unstable surface may be created. Accordingly, overall fluid flow profile may be unstable and further bubbles may be created.

In order to solve the aforementioned drawbacks a specimen leading guide 115 formed in a state of protruding from the slanted surface S is provided between the specimen injection portion 110*a* and the first buffer portion 111. A plurality of specimen leading guides 115 may be formed in a state of protruding from the center area of the slanted surface S, each guide being spaced at a predetermined distance, breaking a surface tension of fluid flow moving from the specimen injection portion 110*a* to the first buffer portion 111 and serving to stabilize flow surface of the fluid (see FIG. 4).

Meanwhile, a pair of vent holes 111*a* may be formed on the first buffer portion 111, which may delay flow velocity of the fluid moving along a first guide 113, which will be described later, and suppress bubbles which may be created in the fluid. The vent hole 111*a* may be formed as a pair, each passing through left-right sides of the upper surface 11 of the first buffer portion 111, respectively (see FIG. 4).

In addition, a profile of the fluid moving from the specimen injection portion 110*a* to the first buffer portion 111, with having a front head toward the center area of the first buffer portion 111, may be preferably inputted and the specimen leading guide 115 is provided for this purpose. However, referring to fluid flow through the first guide 113, both ends of the fluid moving from the specimen injection portion 110*a* to the first buffer portion 111 are moved along wall faces of the first guide 113 wherein the flow velocity of both ends of the fluid moving along wall faces needs to be re-adjusted, that is, delayed for the fluid flow profile to have a front head toward the center area of the first buffer portion 111.

Here, the vent hole 111*a* serves to delay the flow velocity of the fluid moving along wall faces of the first guide 113 through air inputted from outside in order to achieve the aforementioned purpose.

Additionally, with respect to the chip for analyzing fluid 10 according to one embodiment of the present invention, fluid may be moved with structural characteristics of the chip 10, without an outside power source wherein when fluid is filled into a predetermined space without an outside power source, bubbles may be formed on corners of a closed structure and then the bubbles may decrease volume for the fluid to be stored and interrupt fluid flow. The vent hole 111*a* serves to suppress bubble creation and at the same time destroy the bubbles using inputted external air even in case of the bubbles being created. As shown in detail in FIG. 4, the first buffer portion 111 further includes a plurality of mixing pillars 111*b* formed in a state of protruding from the upper surface 11 thereof toward a lower side. The respective mixing pillars 111*b* may be formed as plural pillars in a state of protruding from the upper surface 11 of the first buffer portion 111 toward a lower side, each being spaced from each other at a predetermined distance. The mixing pillars 111*b* serve to increase mixing effects of the fluid and a sample buffer, which will be described later, through increasing a surface area of the firs buffer portion 111, and giving flow direction to the fluid moving from the first buffer portion 111 toward the first conjugate portion 112 side, promoting efficient fluid flow.

The first conjugate portion 112 is provided for a target-being analyzed substance within the fluid moving through the first buffer portion 111 to be reacted with an identification substance. The target-being analyzed substance within the fluid injected through the specimen injection opening 110*b* may be reacted firstly with the sample buffer applied on the lower surface 21, corresponding to a formation location of the specimen injection opening 110*b*, for building an environment beneficial to the reaction, and be stored firstly in the first buffer portion 111 and then be moved through the first conjugate portion 112 and be reacted with identification substance.

The area of the first plate 100 for defining the upper surface 11 of the first conjugate portion 112 may be greater than that of the second plate 200 on which the identification substance is applied. As a result, the identification substance applied on the second plate 200 is to be placed within the first conjugate portion 112 when the first plate 100 and the second plate 200 are connected, and thus connection allowance is to be minimized and the fluid moving through the first conjugate portion 112 is moved surrounding the entire first conjugate portion 112.

Meanwhile, the first conjugate portion 112 may include a pair of first tunnel walls 112*a* each protruding symmetrically from the upper surface 11 of one end and a pair of second tunnel walls 112*b* each protruding symmetrically from the upper surface 11 of the other end.

The first tunnel wall 112*a* and the second tunnel wall 112*b* serve to concentrate fluid flow for the fluid to be flowed in one direction. That is, without the first tunnel wall 112*a* and the second tunnel wall 112*b* the fluid is moved firstly along corners having relatively greater capillary force and thus the fluid flow inputting into the channel portion 120 becomes unstable, making reactivity in the channel portion 120 unstable. In order to avoid this problem the first tunnel wall 112*a* and the second tunnel wall 112*b* are provided as a pillar form configuration which protrude from both ends of the upper surface 11 of the first conjugate portion 112 toward a lower side thereof, and as a result when the fluid is inputted to the first conjugate portion 112, concentration of reaction within the first conjugate portion 112 between a target-being analyzed substance and the identification substance is increased and further flow direction of the fluid discharging from the first conjugate portion 112 is concentrated toward the center thereof.

The first guide 113 is provided for the fluid injected through the specimen injection opening 110*b* not to be leaked outside. As shown in FIG. 4, the first guide 113 is provided with protruding downward within a range of 1-10 um along circumferences of the upper surfaces 11 of the specimen injection portion 110*a* and the first buffer portion 111. As a result, when the first plate 100 and the second plate 200 are connected, the first guide 113 is met entirely with the lower surface 21 and closed.

In addition, one end of the first guide 113 is provided in a state of rupture as a circle form without an edge on a side of the first buffer portion 111 and allows for the fluid inputting to the first conjugate 112 side to be directed and concentrated toward the center thereof.

The second buffer portion 114 is connected to the first conjugate portion 112 and is provided for the fluid passing through the first conjugate portion 112 to be met further with the identification substance. That is, the target-being analyzed substance within the fluid inputted to the first conjugate portion 112 side is to be reacted firstly with the identification substance within the first conjugate portion 112 wherein a part of the target-being analyzed substance is discharged in a state of not being reacted with the identification substance from the first conjugate portion 112. Accordingly, need exists for mixing further the washed identification substance through fluid movement and the not-reacted fluid with the identification substance, and the second buffer portion 114 serves as this function. That is, the second buffer portion 114 is provided to increase fluid volume to a possible range within which the identification substance may be reacted, increasing reliability of the chip for analyzing fluid 10.

Meanwhile, as is clear, referring to FIG. 3, the second buffer portion 114 is provided having smaller volume than that of the first buffer portion 111. This configuration, that is, volume difference between the first buffer portion 111 and the second buffer portion 114, intends to minimize the remaining volume of the fluid received in the second buffer portion 114 and allow for the fluid not being reacted with the identification substance to be moved smoothly to a washing portion 130 side. That is, since potential energy of the fluid stored in the first buffer portion 111 is greater than that of the fluid stored in the second buffer portion 114, the fluid can move smoothly through the first buffer portion 111, the first conjugate portion 112 and the second buffer portion 114.

The second buffer portion 114 includes a plurality of buffer portion pillars 114*a* protruding from the upper surface 11 and a pair of second guide 114*b*.

The buffer portion pillars 114*a* are each spaced at a predetermined distance from each other and protrude from the upper surface 11 of the second buffer portion 114. In case of the buffer portion pillar 114*a* not being provided, the fluid inputting from the first conjugate portion 112 to the second buffer portion 114 side takes a linear laminar flow form, and in this case mixing effect through the second buffer portion 114 may be decreased. The buffer portion pillar 114*a* interrupts this laminar flow of the fluid and increases surface area of the second buffer portion 114, and thus gives sufficient time for the identification substance and the fluid to be reacted in the second buffer portion 114. The buffer portion pillar 114*a* may have a height contacting with or adjacent to the lower surface 21 when the first plate 100 and the second plate 200 are connected.

The second guides 114*b* each protrude symmetrically from the center area of the upper surface 11 of the second buffer portion 114 to a lower side thereof. In case of the second guide 114*b* not being provided, the fluid is flowed toward a direction to arrive firstly at a starting point of the channel portion 120, and when the fluid flow is not concentrated on the center of the channel portion 120, the fluid may not conduct smoothly a specific reaction such as antigen-antibody reaction within the channel portion 120. The second guide 114*b* adjusts the fluid flow for a front head of the fluid to arrive firstly at the center of the channel portion 120 and as a result helps the fluid to conduct smoothly the specific reaction within the channel portion 120. The second guide 114, similarly to the buffer portion pillar 114*a*, may have a height contacting with or adjacent to the lower surface 21 when the first plate 100 and the second plate 200 are connected.

Meanwhile, a pair of water leak proof holes 100*a* may be formed through the first plate 100 adjacent to both sides of the second buffer portion 114. That is, the water leak proof holes 100*a* may formed as a pair through the first plate 100 adjacent to both sides of the second buffer portion 114, respectively. The channel portion 120 according to the present embodiment may be provided in a wall-free form wherein there may arise a problem in that the fluid inputting to the channel portion 120 through the second buffer portion 114 may be leaked outside at a starting point of this wall-free section of the channel portion 120. Accordingly, external air is inputted to the starting point of the wall-free section of the channel portion 120 through the water leak proof holes 100*a* and the fluid passing at the starting point of the channel portion 120 undergoes equal air pressure, inducing a stable flow of the fluid and avoiding fluid leaking outside.

Additionally, the channel portion 120 is provided for the fluid received in the pre-treatment portion 110 to be moved and to undergo a specific reaction such as antigen-antibody reaction wherein the channel portion includes a channel groove 120*a* formed along a lengthwise direction of the upper surface 11, and a pair of chamfering portions 124,125 provided by chamfering lower ends along a lengthwise direction of both side walls 121,122 forming the channel groove 120*a*.

The channel groove 120*a* may be formed along a lengthwise direction of one side of the first plate 100 and constitutes a closed space within which a channel C is formed when the first plate 100 and the second plate 200 are connected. The channel portion 120 according to the present embodiment may be configured as a wall-free form and more detailed description of the wall-free typed-channel portion 120 will be omitted (see the inventions described in Korean Patent Registration Nos. 10-0905954, 10-0900511, 10-0878229 and U.S. Ser. No. 12/667,371, which were filed by the same applicant as the present invention).

Meanwhile, the chamfering portions 124,125 are provided by chamfering lower ends along a lengthwise direction of both side walls 121,122 forming the channel groove 120*a*. The chamfering portions 124,125 form evenly the surface of the fluid flowing along the channel portion 120, allowing the fluid to be flowed stably while keeping an ideal profile form.

That is, since flow velocity F1 on a location contacting with the chamfering portions 124,125 has smaller value than flow velocity F2 on a location not contacting with the chamfering portions 124,125, the front head part of the fluid takes a protrusion form in comparison to both ends and as a result the fluid may flow stably along the channel portion 120. Here, differently from the present embodiment, the chamfering portions 124,125 may be provided by chamfering only one side inner wall (124 or 125) of the channel portion 120 along a lengthwise direction of the channel portion 120 and further may be provided intermittently by chamfering only a part of the inner walls 124,125 of the channel portion 120 rather than being provided continuously (not shown). In addition, the chamfering extent of the chamfering portions 124,125 may be adjusted, if necessary.

Meanwhile, a flow velocity delay hole 120*b* is formed through the first plate 100 on one end of the channel portion 120 adjacent to a washing portion 130 side. The flow velocity delay hole 120*b* delays the flow velocity of the fluid passing through the channel portion 120 and further prevents the fluid from being leaked outside the channel portion 120, promoting stable effect on the fluid flow.

The washing portion 130 may be provided on one end of the chip for analyzing the fluid, adjacent to an ending point of the channel portion 120, in which the fluid having passed through the channel portion 120 is received. The washing portion 130 may provide a space for receiving another substance besides the target-being analyzed substance fixed to the channel portion 120. The other substance besides the target-being analyzed substance contained within the fluid flowing along the channel portion 120 under capillary force serves as a kind of noise, and the washing portion 130 may provide a space capable of receiving the noise, increasing analysis reliability of the chip for analyzing fluid. The washing portion 130 may include a washing channel introduction portion 132 provided on one end of the channel portion 120, a washing channel 131 for receiving the fluid passing through the channel portion 120, a plurality of washing portion pillars 133 provided in the washing channel 131, and a washing portion vent hole 131*b* formed on the tip end of the washing channel 131.

The washing channel introduction portion 132 may connect one end of the channel portion 120 to the washing channel 131. The washing channel introduction portion 132, as shown in FIG. 3, is formed having a gradual step difference such that the distance between the first plate 100 and the second plate 200 increases gradually as the washing channel introduction portion proceeds toward the washing channel 131 side. As a result of this configuration, the flow velocity of the fluid flowing along the washing channel introduction portion 132 decreases gradually and thus a sufficient reaction time period for the target-being analyzed substance within the fluid may be ensured. Additionally, the fluid may be filled steadily to the washing channel 131 through the washing channel introduction portion 132, helping the fluid to be flowed in a stable form.

The washing channel 131 may be provided for receiving noise besides a target-being analyzed substance flowing along the channel portion 120 and being reacted. The washing channel 131 may be provided having larger volume than that of the washing channel introduction portion 132. Additionally, a washing volume increasing portion 131*a* may be provided having a gradual step difference to increase the distance between the first plate 100 and the second plate 200, on one end of the washing channel 131. Here, the reasons for the washing channel 131 having larger volume than that of the washing channel introduction portion 132 and the washing volume increasing portion 131*a* being provided, are the same as the washing channel introduction portion 132 being formed having a gradual step difference and thus repetitive descriptions thereof are omitted.

The washing volume increasing portion 131*a* may receive a greater amount of the fluid and thus help the fluid containing other substance besides the target-being analyzed substance to be removed.

The washing portion pillar 133 may be formed mostly through the washing channel 131 and provided as plural pillars protruding from the upper surface 11 toward a lower side. In addition, the washing portion pillar 133 may be formed to be gradually denser as it proceeds to the tip end of the washing channel 131, it intends to allow the fluid to be sufficiently moved to the tip end of the washing channel 131 through increasing capillary force. That is, the fluid according to the present embodiment may be moved only through capillary force wherein the capillary force is gradually weakened from one end of the chip for analyzing fluid to the other end thereof and thus the washing portion pillar 133 is provided for compensating this unbalanced capillary force. The washing portion pillar 133 may increase surface area with which the fluid may contact, enforcing the weakened capillary force.

The washing portion vent hole 131*b* may be formed through the first plate 100 on one end of the washing channel 131 at a centre area of a widthwise direction of the first plate 100. The washing portion vent hole 131*b* may create pressure and air flow within the washing channel 131 for the fluid to proceed to the washing portion 130. Alternatively, the washing portion vent hole 131*b* may be formed at a sufficiently large size so as not to be blocked when the first plate 100 and the second plate 200 are bonded.

Meanwhile, the second plate 200 may be connected to the first plate 100 to form the channel portion 120. The second plate 200 may be connected to a lower side of the predetermined area (S, see FIG. 1) of the first plate 100 and further may be made of general slide glass, and thus detailed description thereof is omitted.

Hereinafter, the employing principle of the chip for analyzing the fluid 10 according to the present embodiment will be described briefly.

First, a target-being analyzed fluid is injected through the specimen injection opening 110*b* and the target-being analyzed substance is reacted first with a sample buffer applied at a point of the lower surface 21, corresponding to the specimen injection opening 110*b*. The sample buffer serves to help the target-being analyzed substance contained within the fluid to be reacted smoothly with an identification substance applied at a point of the lower surface 21, corresponding to an area where the first conjugate portion 112 is formed, and the reaction substance applied on the channel portion 120.

The fluid reacted with the sample buffer is received firstly into the first buffer portion 111 and is reacted with the identification substance applied on the conjugate portion 112 and then received secondly into the second buffer portion 114. At this time, the vent hole 111*a* formed on the first buffer portion 111 suppresses bubble creation within the first buffer portion 111 and remaining volume of the fluid received in the second buffer portion 114 is minimized through a property of the second buffer portion 114 that has a smaller volume than that of the first buffer portion 111, and the fluid not being reacted with the identification substance is moved smoothly to the washing portion 130 side.

The fluid stored in the second buffer portion 114 is inputted to the channel portion 120 through capillary force and the fluid flows stably keeping an ideal profile through the pair of chamfering portions 124,125 provided on the channel portion 120. The fluid moving along the channel portion 120 undergoes a specific reaction such as an antigen-antibody reaction with a reaction substance applied on a predetermined area of the channel portion 120, and as a result the fluid can be analyzed and shown outside. Finally, remaining fluid not being reacted in the channel portion 120 is received through the washing portion 130.

According to a chip for analyzing fluids 10, a moving pattern of the fluid passing through the channel portion 120 is formed evenly and thus bubble creation is decreased and reproducibility thereof is ensured and further a signal detection from a target-being analyzed substance is performed easily.

While the present invention is described referring to the preferred embodiment, the present invention is not limited thereto, and thus various variation and modification 29 can be made without departing from a scope of the present invention.

What is claimed is:

1. A chip for analyzing fluid being moved without an outside power source, comprising:

upper and lower plates assembled with each other;

a channel through which the fluid moves and formed inside the chip between the upper and lower plates, the channel comprising:

a pre-treatment portion into which fluid of a target-being analyzed substance is injected and mixed with an identification substance, wherein the pre-treatment portion includes:

a specimen injection portion which receives the fluid injected through a specimen injection opening formed at the upper plate of the chip, the specimen injection portion having a first ceiling formed at a lower surface of the upper plate and spaced apart from a bottom formed on an upper surface of the lower plate of the chip;

a first buffer portion arranged downstream of the specimen injection portion, such that the fluid is firstly received in the first buffer portion, the first buffer portion having a second ceiling formed at the lower surface of the upper plate and arranged downstream of the first ceiling, wherein the second ceiling is upwardly extended from the first ceiling so that the second ceiling is higher than the first ceiling from the bottom; and at least one specimen leading guide which is provided between the specimen injection portion and the first buffer portion and destroys surface tension of the fluid flow moving from the specimen injection portion to the first buffer portion side and thus stabilizes flow surface of the fluid, wherein the specimen leading guide comprises plural specimen leading guides which protrude from a center area of a slanted surface formed at the lower surface of the upper plate and connecting the first ceiling and the second ceiling, to be spaced from each other at a predetermined space;

a channel portion connected to the pre-treatment portion and arranged downstream of the pre-treatment portion, the channel portion through which the fluid injected into the pre-treatment portion is moved and in which a specific reaction of the fluid such as an antigen-antibody reaction is conducted; and a washing portion connected to the channel portion and arranged downstream of the channel portion, the washing portion into which the fluid passing through the channel portion is received.

2. A chip for analyzing fluid being moved without outside power source according to claim 1, wherein the pre-treatment portion further comprises a first guide provided along circumferences of the first and second ceilings.

3. A chip for analyzing fluid being moved without an outside power source according to claim 2, wherein at least one vent hole is formed through the first buffer portion, which delays flow velocity of both ends of the fluid moving along the first guide and suppresses bubbles to be created in the fluid.

4. A chip for analyzing fluid being moved without an outside power source according to claim 3, wherein the vent hole comprises a pair of vent holes each formed through left and right sides of the second ceiling of the first buffer portion, respectively.

5. A chip for analyzing fluid being moved without an outside power source according to claim 2, wherein the first guide protrudes toward the bottom within a range of 1-10 μm along circumferences of the first and second ceilings.

6. A chip for analyzing fluid being moved without an outside power source according to claim 1, wherein the first buffer portion comprises a plurality of mixing pillars which protrude from the second ceiling of the buffer portion toward the bottom to increase a surface area with which the fluid contacts.

7. A chip for analyzing fluid being moved without an outside power source according to claim 1, wherein the pre-treatment portion further comprises:

a second buffer portion into which the fluid is received secondly and is spaced at a predetermined distance from the first buffer portion and has smaller volume than that of the first buffer portion, the second buffer portion having a third ceiling formed at the lower surface of the upper plate, arranged downstream of the second ceiling, and higher than the first ceiling and lower than the second ceiling from the bottom; and a first conjugate portion which is provided between the first buffer portion and the second buffer portion for the target-being analyzed substance within the fluid moving from the first buffer portion toward the second buffer portion to be reacted with the identification substance, the first conjugate portion having a fourth ceiling formed at the lower surface of the upper plate between the second ceiling and the third ceiling and positioned lower than the second and third ceilings from the bottom.

8. A chip for analyzing fluid being moved without an outside power source according to claim 7, wherein the first conjugate portion comprises at least one first tunnel wall which protrudes from the fourth ceiling of the first conjugate toward the bottom and concentrates fluid flow for the fluid moving from the first buffer portion toward the second buffer portion to be flowed in one direction.

9. A chip for analyzing fluid being moved without an outside power source according to claim 8, wherein the first tunnel wall comprises a pair of tunnel walls each protruding symmetrically on both sides of one end of the first conjugate portion.

10. A chip for analyzing fluid being moved without an outside power source according to claim 7, wherein the first conjugate portion comprises at least one second tunnel wall which protrudes from the fourth ceiling of the first conjugate toward the bottom and concentrates fluid flow for the fluid moving from the first buffer portion toward the second buffer portion to be flowed in one direction.

11. A chip for analyzing fluid being moved without an outside power source according to claim 10, wherein the second tunnel wall comprises a pair of tunnel walls each protruding symmetrically on both sides of the other end of the first conjugate portion.

12. A chip for analyzing fluid being moved without an outside power source according to claim 10, wherein the second buffer portion comprises a plurality of buffer portion pillars which protrude from the third ceiling of the second buffer portion toward the bottom and mix the fluid with the identification substance.

13. A chip for analyzing fluid being moved without an outside power source according to claim 7, wherein the second buffer portion comprises at least one second guide which protrudes from the third ceiling of the second buffer portion toward the bottom and concentrates the fluid flow toward the center.

14. A chip for analyzing fluid being moved without an outside power source according to claim 13, wherein the second guide comprises a pair of guides each protruding downward at left and right sides of the third ceiling of the second buffer portion.

15. A chip for analyzing fluid being moved without an outside power source according to claim 7, wherein a pair of water leak proof holes is formed in both sides adjacent to the second buffer portion, respectively.

16. A chip for analyzing fluid being moved without an outside power source according to claim 1, wherein the specimen injection portion comprises a plurality of injection portion pillars which protrude from the first ceiling of the specimen injection portion toward the bottom.

17. A chip for analyzing fluid being moved without an outside power source according to claim 1, wherein the channel portion comprises a chamfering portion at least a part of which is chamfered along a lower end lengthwise direction of at least one side wall among side walls of the channel portion.

18. A chip for analyzing fluid being moved without an outside power source according to claim 17, wherein the chamfering portion comprises a pair of chamfering portions provided continuously along a lengthwise direction of both side walls of the channel portion.

19. A chip for analyzing fluid being moved without an outside power source according to claim 17, wherein a flow velocity delay hole is formed through on one end of the channel portion.

20. A chip for analyzing fluid being moved without an outside power source according to claim 1, wherein the washing portion comprises a washing channel into which the fluid passing through the channel portion is received and a washing channel introduction portion which connects the channel portion with the washing channel.

21. A chip for analyzing fluid being moved without an outside power source according to claim 20, wherein the washing channel introduction portion is provided having smaller volume than that of the washing channel.

22. A chip for analyzing fluid being moved without an outside power source according to claim 20, wherein the washing channel introduction portion has a first slant ceiling formed at the lower surface of the upper plate and which becomes ascendant as the washing channel introduction portion proceeds to the washing channel.

23. A chip for analyzing fluid being moved without an outside power source according to claim 20, wherein the washing channel comprises a washing volume increasing portion provided on one end of the washing channel and having a second slant ceiling formed at the lower surface of the upper plate and extended from a flat ceiling of the washing channel, the flat ceiling being formed at the lower surface of the upper plate and connected to the first slant ceiling, wherein the second slant ceiling becomes ascendant as the washing volume increasing portion proceeds to a downstream end of the channel of the chip.

24. A chip for analyzing fluid being moved without an outside power source according to claim 20, wherein the washing channel comprises a plurality of washing pillar portions which protrude from the flat ceiling of the washing channel.

25. A chip for analyzing fluid being moved without an outside power source according to claim 24, wherein the plural pillar portions are formed such that a number of the pillar portions per a unit area increases along a direction that the fluid in the washing channel flows.

26. A chip for analyzing fluid being moved without an outside power source according to claim 20, wherein at least one washing portion vent hole is formed through on one end of the washing channel.

27. A chip for analyzing fluid being moved without an outside power source according to claim 26, wherein the washing portion vent hole is formed on the center area in a widthwise direction of the washing channel.

* * * * *